US010636348B2

(12) United States Patent
Kim et al.

(10) Patent No.: US 10,636,348 B2
(45) Date of Patent: Apr. 28, 2020

(54) DISPLAY DEVICE INCLUDING DATA DRIVER DETERMINING ERROR OF IMAGE DATA AND OPERATING METHOD THEREOF

(71) Applicant: SAMSUNG DISPLAY CO., LTD., Yongin-si, Gyeonggi-do (KR)

(72) Inventors: Ga Na Kim, Yongin-si (KR); Whee Won Lee, Yongin-si (KR); Myeong Su Kim, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 37 days.

(21) Appl. No.: 15/791,497

(22) Filed: Oct. 24, 2017

(65) Prior Publication Data

US 2018/0122295 A1 May 3, 2018

(30) Foreign Application Priority Data

Nov. 1, 2016 (KR) ..... 10-2016-0144626

(51) Int. Cl.

| | |
|---|---|
| ***G09G 3/20*** | (2006.01) |
| ***G09G 3/3233*** | (2016.01) |
| ***G09G 3/3275*** | (2016.01) |
| ***G09G 3/3225*** | (2016.01) |

(52) U.S. Cl.

CPC ..... *G09G 3/2096* (2013.01); *G09G 3/20* (2013.01); *G09G 3/3225* (2013.01); *G09G 3/3233* (2013.01); *G09G 3/3275* (2013.01); *G09G 2310/0275* (2013.01); *G09G 2310/0289* (2013.01); *G09G 2310/08* (2013.01); *G09G 2330/021* (2013.01); *G09G 2330/12* (2013.01); *G09G 2370/08* (2013.01)

(58) Field of Classification Search

CPC .. G09G 3/2096; G09G 3/3233; G09G 3/3275; G09G 3/20; G09G 3/3225; G09G 2310/0289; G09G 2310/08; G09G 2330/021; G09G 2330/12; G09G 2310/0275; G09G 2370/08

See application file for complete search history.

(56) References Cited

U.S. PATENT DOCUMENTS

| | | | | |
|---|---|---|---|---|
| 7,397,270 | B1 | 7/2008 | Luo et al. | |
| 8,654,155 | B2 * | 2/2014 | Yu | G09G 3/20 345/204 |
| 2004/0034823 | A1 * | 2/2004 | Watkins | G06F 21/52 714/724 |
| 2007/0083790 | A1 * | 4/2007 | Nurmi | G06F 11/1004 714/12 |
| 2012/0242628 | A1 * | 9/2012 | Yuan | G09G 3/20 345/204 |
| 2014/0078133 | A1 * | 3/2014 | Lee | G09G 3/2092 345/213 |
| 2016/0063910 | A1 * | 3/2016 | An | G09G 3/3233 345/691 |
| 2017/0366759 | A1 * | 12/2017 | Cheng | H04N 5/268 |

* cited by examiner

*Primary Examiner* — Kwang-Su Yang
(74) *Attorney, Agent, or Firm* — Cantor Colburn LLP

(57) ABSTRACT

A display device includes: a timing controller which receives image data including high logics and low logics from the outside; a data driver which generates a data signal, based on the image data; and pixels which emit light with a luminance corresponding to the data signal, where the data driver determines an error of the image data, based on a checksum included in the image data.

18 Claims, 7 Drawing Sheets

DISPLAY DEVICE INCLUDING DATA DRIVER DETERMINING ERROR OF IMAGE DATA AND OPERATING METHOD THEREOF

This application claims priority to Korean Patent Application No. 10-2016-0144626, filed on Nov. 1, 2016, and all the benefits accruing therefrom under 35 U.S.C. 119, the content of which in its entirety is herein incorporated by reference.

BACKGROUND

1. Field

Embodiments of the disclosure relate to a display device and an operating method thereof.

2. Description of the Related Art

With the development of information technologies, the importance of display devices has increased. Accordingly, display devices such as a liquid crystal display device ("LCD"), an organic light emitting diode display device ("OLED"), and a plasma display panel ("PDP") are increasingly used.

In general, a display device includes a data driver for supplying a data signal to data lines, a scan driver for supplying a scan signal to scan lines, a pixel unit including pixels located in a region defined by the scan lines and the data lines, and a timing controller for controlling driving of the data driver and the scan driver.

SUMMARY

According to an embodiment of the disclosure, a display device includes: a timing controller which receives image data including high logics and low logics from the outside; a data driver which generates a data signal, based on the image data; and pixels which emit light with a luminance corresponding to the data signal, where the data driver determines an error of the image data, based on a checksum included in the image data.

In an embodiment, the data driver may receive first image data from the timing controller during a first period of a frame period, and the data driver may determine an error of the first image data, based on a checksum included in the first image data.

In an embodiment, the checksum included in the first image data may be the number of the high logics or the low logics existing in the first image data.

In an embodiment, the data driver may count a number of high logics or low logics of the first image data, and the data driver may generate feedback information on the error by comparing the counted number of the high logics or the low logics of the first image data with the checksum included in the first image data.

In an embodiment, the timing controller may change at least one of a level of the first image data and a slew rate of the first image data, based on the feedback information.

In an embodiment, when the counted number of the high logics of the first image data is smaller than the checksum included in the first image data, the timing controller may increase the level of the first image data by a predetermined amount.

In an embodiment, when the counted number of the high logics of the first image data is larger than the checksum included in the first image data, the timing controller may decrease the level of the first image data by a predetermined amount.

In an embodiment, when the counted number of the high logics of the first image data is smaller than the checksum included in the first image data, the timing controller may increase the slew rate of the first image data by a predetermined amount.

In an embodiment, when the counted number of the high logics of the first image data is larger than the checksum included in the first image data, the timing controller may decrease the slew rate of the first image data by a predetermined amount.

In an embodiment, the timing controller may receive second image data during a second period of the frame period, which is subsequent to after the first period in the frame period, and the timing controller may change at least one of a level of the second image data and a slew rate of the second image, based on the feedback information.

In an embodiment, the data driver may generate the data signal, based on the second image data.

In an embodiment, the data driver may include a first data driver and a second data driver, which supply the data signal to different pixels among the pixels.

In an embodiment, the first and second data drivers may receive the image data during different periods from each other, and each of the first and second data drivers may determine the error of the image data, based on the checksum included in the image data.

In an embodiment, the first and second data drivers may receive the image data during periods, at least some of which overlap with each other, and each of the first and second data drivers may determine the error of the image data, based on the checksum included in the image data.

According to another embodiment of the disclosure, a method for operating a display device includes: receiving, by a data driver of the display device, first image data including high logics and low logics from a timing controller of the display device during a first period of a frame period; determining, by the data driver, an error of the first image data, based on a checksum included in the first image data; generating, by the data driver, feedback information on the determined error and transmitting the generated feedback information to the timing controller; and changing, by the timing controller, at least one of a level of the first image data and a slew rate of the first image data, based on the feedback information.

In an embodiment, the method may further include: receiving, by the data driver, second image data from the timing controller during a second period of the frame period, which is subsequent to the first period; changing, by the data driver, at least one of a level of the second image data and a slew rated of the second image, based on the feedback information; generating, by the data driver, a data signal, based on the second image data; and emitting, by pixels, light with a luminance corresponding to the data signal.

In an embodiment, the determining, by the data driver, the error of the first image data, using the checksum included in the first image data may include: counting a number of high logics or low logics of the first image data; and determining the error by comparing the counted number of the high logics or the low logics of the first image data with the checksum included in the first image data.

In an embodiment, the determining, by the data driver, the error of the first image data, using the checksum included in the first image data may include: increasing the level of the first image data by a predetermined amount when the counted number of the high logics of the first image data is larger than the checksum included in the first image data, and decreasing the level of the first image data by a predetermined amount when the counted number of the high logics of the first image data is smaller than the checksum included in the first image data.

In an embodiment, the changing, by the data driver, the at least one of the level of the second image data and the slew rated of the second image, using the feedback information may include increasing the slew rate of the first image data by a predetermined amount when the counted number of the low logics of the first image data is larger than the checksum included in the first image data.

In an embodiment, the changing, by the data driver, the at least one of the level of the second image data and the slew rated of the second image, using the feedback information may include decreasing the slew rate of the first image data by a predetermined amount when the counted number of the low logics of the first image data is smaller than the checksum included in the first image data.

BRIEF DESCRIPTION OF THE DRAWINGS

Exemplary embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the exemplary embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
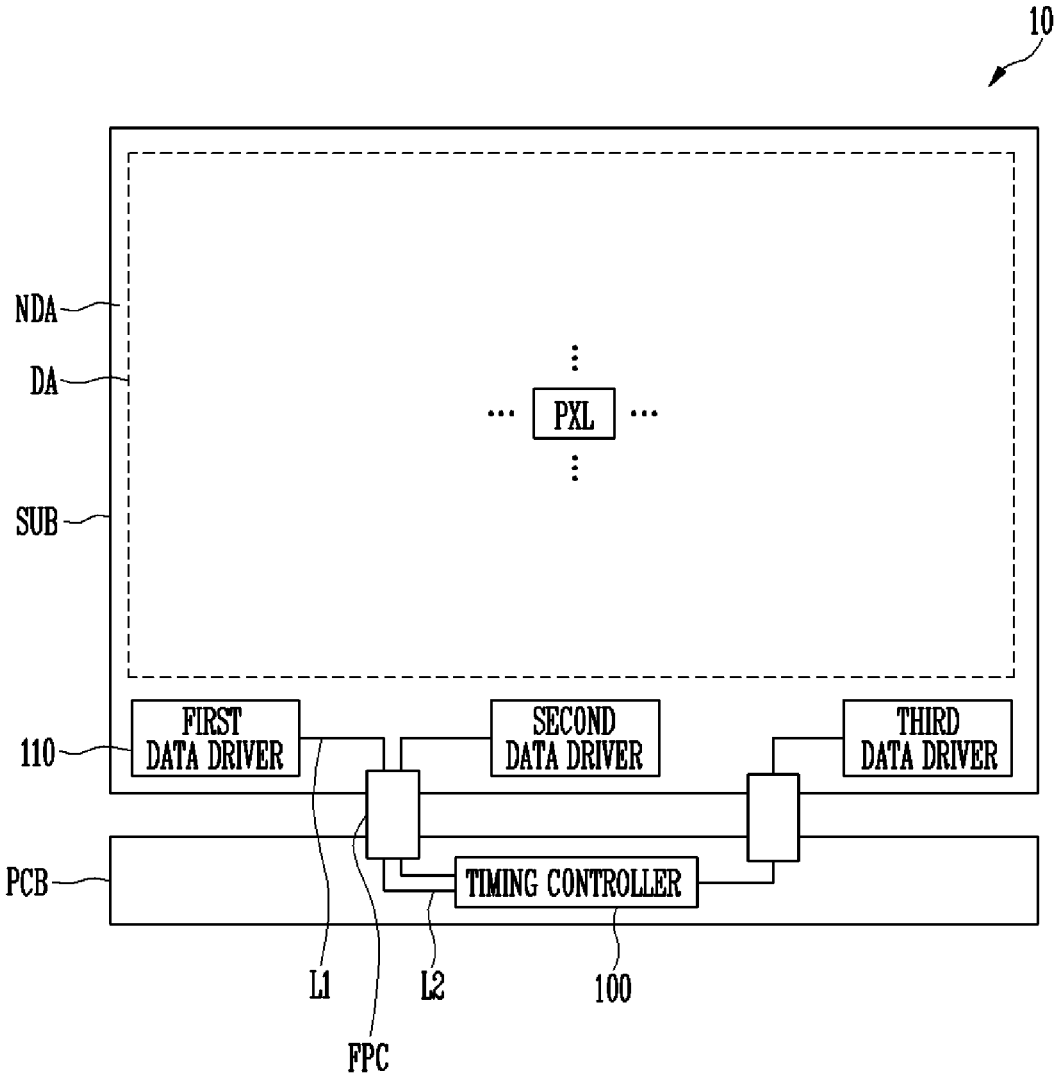
FIG. 1 is a schematic plan view of a display device according to an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The embodiments according to the concept of the disclosure can be variously modified and have various shapes. Thus, the embodiments are illustrated in the drawings and are intended to be described herein in detail. However, the embodiments according to the concept of the disclosure are not construed as limited to specified disclosures, and include all changes, equivalents, or substitutes that do not depart from the spirit and technical scope of the disclosure.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

It will be understood that when an element is referred to as being "on" another element, it can be directly on the other element or intervening elements may be present therebetween. In contrast, when an element is referred to as being "directly on" another element, there are no intervening elements present. It will be understood that when an element is referred to as being "connected" or "coupled" to another element, it can be directly connected or coupled to the other element or intervening elements may also be present. In contrast, when an element is referred to as being "directly connected" or "directly coupled" to another element, no intervening elements are present. Meanwhile, other expressions describing relationships between components such as "between," "immediately between" or "adjacent to" and "directly adjacent to" may be construed similarly.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In one embodiment, for example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the invention will be described in detail with reference to the accompanying drawings.

Figure 2:
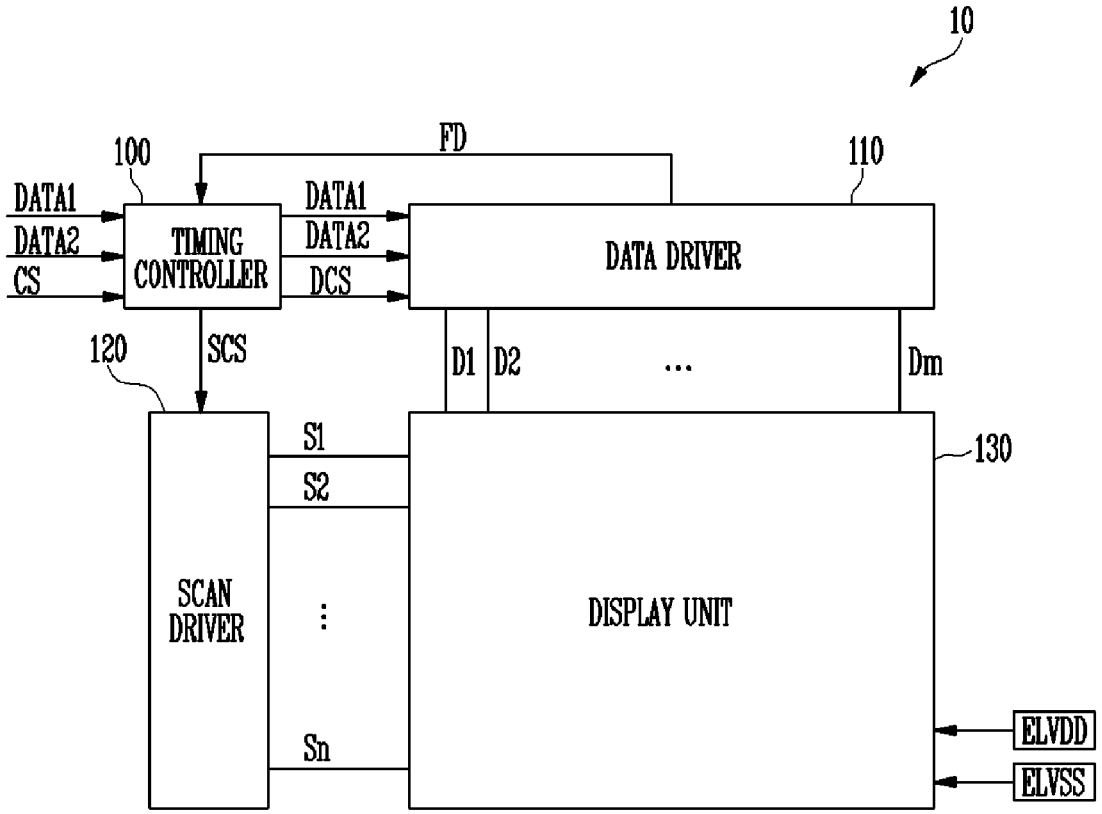
FIG. 2 is a schematic block diagram of the display device according to the embodiment of the disclosure.

FIG. 1 is a schematic plan view of a display device according to an embodiment of the disclosure. FIG. 2 is a schematic block diagram of the display device according to the embodiment of the disclosure.

Referring to FIG. 1, an embodiment of the display device 10 may include a display substrate SUB, a flexible circuit board FPC, and a printed circuit board PCB.

The display substrate SUB may have a rectangular plate shape with two pairs of sides parallel to each other. In the display substrate SUB, any one pair of sides among the two pairs of sides may be longer than the other pair of sides, but the disclosure is not limited thereto. In one embodiment, for example, the display substrate SUB may have one of various shapes such as a closed-shape polygon including linear sides, a circle or ellipse including curved sides, a semicircle or semi-ellipse including linear and curved sides, and a rectangle including curved corner portions.

The display substrate SUB may be divided into a display area DA, in which an image is displayed, and a non-display area NDA located at the periphery of the display area DA.

In an embodiment, the display area DA may be an area, in which a predetermined image is displayed due to light emitted from pixels PXL, and the non-display area NDA is an area in which driving circuits, e.g., a data driver 110, a scan driver and the like, are disposed to drive the pixels PXL in the display area DA. In an embodiment, the pixels PXL may be disposed substantially in a matrix form including pixel columns and pixel rows.

The pixels PXL that display an image may be disposed in the display area DA. In one embodiment, for example, the pixel PXL may emit light of any one of red, green and blue colors, but the disclosure is not limited thereto. In one alternative embodiment, for example, the pixel PXL may emit light of cyan, magenta, yellow, or the like.

The display substrate SUB may display, through the pixels PXL, arbitrary visual information, e.g., a text, a video, a picture, a two-dimensional or three-dimensional image, etc. The display substrate SUB may be an organic light emitting display panel, a liquid crystal display panel, a plasma display panel or the like, but the disclosure is not limited thereto.

Although not shown in FIG. 1, scan lines in a pixel row direction and data lines in a pixel column direction may be disposed in the display area DA. In an embodiment, driving circuits for driving the pixels PXL and lines electrically coupled to the scan lines and the data lines in the display area DA may be disposed in the non-display area NDA.

The data driver 110 may supply a data signal to the pixel PXL such that the pixels PXL may emit light with a predetermined luminance. In an embodiment, as shown in FIG. 1, the data driver 110 is provided as a separate component, but not being limited thereto. Alternatively, the data driver 110 and the scan driver may be implemented as a single driving circuit.

The data driver 110 may be electrically coupled to pad electrodes (not shown) disposed on the display substrate SUB through a first line L1.

The flexible circuit board FPC is a circuit having flexibility, and may be implemented as any one of a film substrate and a plastic substrate, including a polymer organic substance.

A side of the flexible circuit board FPC may be attached to the display substrate SUB through the pad electrodes (not shown) disposed on the display substrate SUB, and an opposing side of the flexible circuit board FPC may be attached to the printed circuit board PCB through pad electrodes (not shown) disposed on the printed circuit board PCB.

The printed circuit board PCB may include a timing controller 100 for controlling the driving circuits disposed on the display substrate SUB.

The timing controller 100 may be coupled to the pad electrodes (not shown) disposed on the printed circuit board PCB through a second line L2.

In some embodiments, at least one of the printed circuit board PCB and the flexible circuit board FPC may be implemented in the form of chip-on-glass, chip-on-plastic, tape-carrier-package, chip-on-film, or the like.

In such an embodiment, each of the display substrate SUB and the printed circuit board PCB may be a flexible substrate, and may be implemented as any one of a film substrate and a plastic substrate, including a polymer organic substance.

Referring to FIG. 2, an embodiment of the display device 10 may include the timing controller 100, the data driver 110, a scan driver 120, and a display unit 130.

In FIG. 2, for convenience of illustration, other components shown in FIG. 1 (e.g., the display substrate SUB, the flexible circuit board FPC, and the printed circuit board PCB) of the display device 10 are not shown.

In an embodiment, the scan driver 120 may supply a scan signal to scan lines S1 to Sn in response to a scan control signal SCS. In one embodiment, for example, the scan driver 120 may sequentially supply the scan signal to the scan lines S1 to Sn.

The data driver 110 may receive a data control signal DCS, first image data DATA1, and second image data DATA2 from the timing controller 100.

The data driver 110 may receive the first image data DATA1 from the timing controller 100 during a first period, and receive the second image data DATA2 from the timing controller 110 during a second period. In an embodiment, the first image data DATA1 is test data for measuring a data transmission error between the data driver 110 and the timing controller 100, and may not be image data supplied to the pixel. In such an embodiment, the second image data DATA2 may be image data supplied to the pixel to display an image. In such an embodiment, the first and second data DATA1 and DATA2 are digital signals, including high and low logics.

A resistive element caused by a line, etc. may exist between the data driver 110 and the timing controller 100, and the first and second image data DATA1 and DATA2 that the data driver 110 receive from the timing controller 100 may include an error generated due to the resistive element.

In an embodiment, the data driver 110 may determine an error of the first image data DATA1, based on (e.g., using) a checksum included in the first image data. In such an embodiment, the checksum refers to the actual number of high logics (e.g., logic levels or voltages levels) or low logics existing in the first image data.

In an embodiment, the data driver 110 may count a number of high logics or low logics of the first image data DATA1 received from the timing controller 100, and transmit, to the timing controller 100, feedback information FD generated by comparing a counting result (i.e., the counted number of the high logics or the low logics) with the checksum.

In one embodiment, for example, when the checksum included in the first image data DATA1 has a value of n (n is a natural number), and the value obtained as the data driver 110 counts the number of high logics or low logics of the first data DATA1 has a valve of n+1 or n−1, the data driver 110 may generate feedback information FD indicating that the counting result is larger than the checksum or a result that the counting result is smaller than the checksum, and transmit the generated feedback information FD to the timing controller 100.

In such an embodiment, although the checksum included in the first image data DATA1 is equal to the value obtained as the data driver 110 counts the number of high logics or low logics of the first image data DATA1, the data driver 110 may generate feedback information FD indicating that the counting result is equal to the checksum and transmit the generated feedback information FD to the timing controller 100.

The data driver 110 may generate a data signal, based on the second image data DATA2, and supply the data signal to the pixels PXL through data lines D1 to Dm.

The timing controller 100 may receive a control signal CS, first image data DATA1 and second image DATA2 from an external processor, e.g., an application processor ("AP"), a mobile AP, a central processing unit ("CPU"), a graphic processing unit ("GPU"), or the like.

The timing controller 100 may generate the scan control signal SCS for controlling the scan driver 120 and the data control signal DCS for controlling the data driver 110, based on the control signal CS.

In one embodiment, for example, the control signal may include a dot clock, a data enable signal, a vertical synchronization signal, and a horizontal synchronization signal.

The timing controller 100 may supply the scan control signal SCS to the scan driver 120, supply the data control signal DCS to the data driver 110, and supply the first image data DATA1 including the checksum and the second image data DATA2 to the data driver 110.

The timing controller 100 may supply the first image data DATA1 to the data driver 110 during the first period, and change at least one of a level (e.g., a high level) of the first image data DATA1 and a slew rate of the first image data DATA1, based on the feedback information FD received from the data driver 110 during the first period.

In an embodiment, when the counting result of high logics or low logics of the first image data DATA1 does not correspond to the checksum, the timing controller 100 may increase or decrease at least one of the level and the slew rate of the first image data DATA1 according to a preset value.

The timing controller 100 may provide, to the data driver 110, first image data, at least one of the level and the slew rate of which is changed (hereinafter, referred to as change data). The data driver 110 may regenerate feedback information by counting a number of high logics or low logics of the change data and comparing a counting result with a checksum included in the change data. The timing controller 100 may change at least one of the level and the slew rate of the change data by determining whether the counting result of high logics or low logics of the change data corresponds to the checksum, based on the regenerated feedback information FD.

In an embodiment, as described above, the timing controller 100 and the data driver 110 may repeat the above-described processes until the counting result of high logics or low logics of the change data corresponds to the checksum. The above-described processes of the timing controller 100 and the data driver 110 are performed during the first period.

When the counting result of high logics or low logics of the change data corresponds to the checksum, the timing controller 100 may change a level (e.g., a high level) of the second image data DATA2 and a slew rate of the second image data DATA2 to correspond to the level and the slew rate of the change data during the first period or the second period.

In such an embodiment, the timing controller 100 may supply the second image data DATA2 to the data driver 110 during the second period.

The display unit 130 includes the pixels PXL, and may correspond to the display area DA shown in FIG. 1.

The pixels PXL may be coupled to the data lines D1 to Dm and the scan lines S1 to Sn. In one embodiment, for example, the pixels PXL may be arranged in a matrix form and disposed at intersection areas of the data lines D1 to Dm with the scan lines S1 to Sn.

In an embodiment, the pixels PXL may be supplied with a data signal and a scan signal through the data lines D1 to Dm and the scan lines S1 to Sn, and each of the pixels PXL may include a light emitting device (e.g., an organic light emitting diode). In such an embodiment, the pixels PXL may be coupled to a first power source ELVDD and a second power source ELVSS.

When a scan signal is supplied to one scan line of the scan lines S1 to Sn, pixels PXL coupled to the one scan line may be supplied with a data signal transmitted from the data lines D1 to Dm. In such an embodiment, each of the pixels PXL supplied with the data signal may generate light corresponding to current flowing from the first power source ELVDD to the second power source ELVSS via the light emitting device.

Figure 3:
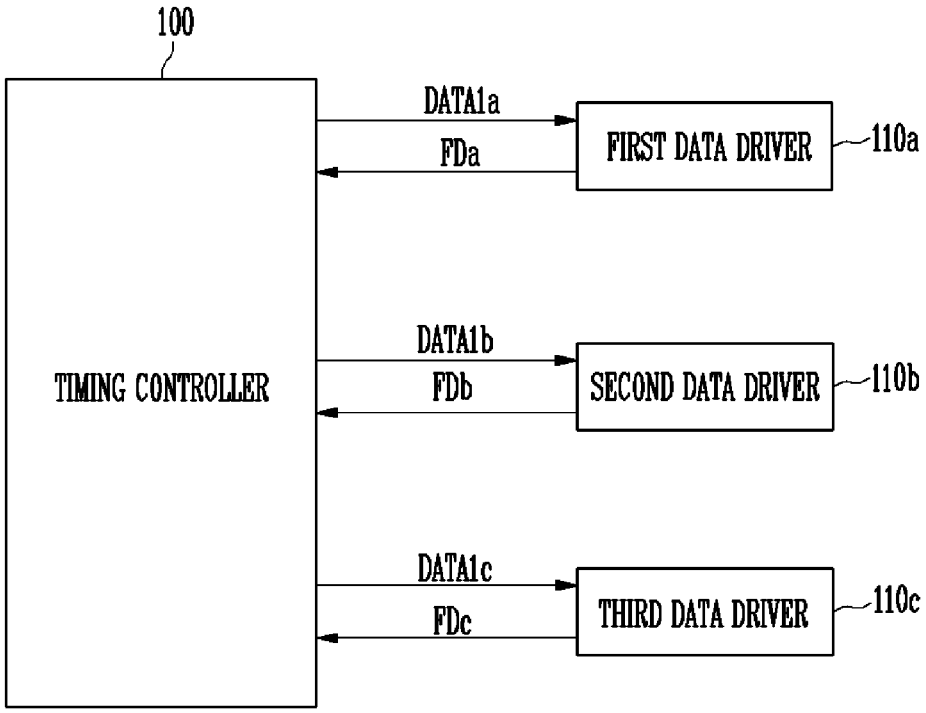
FIG. 3 is a schematic block diagram of a timing controller and data drivers according to an embodiment of the disclosure.
Figure 4A:
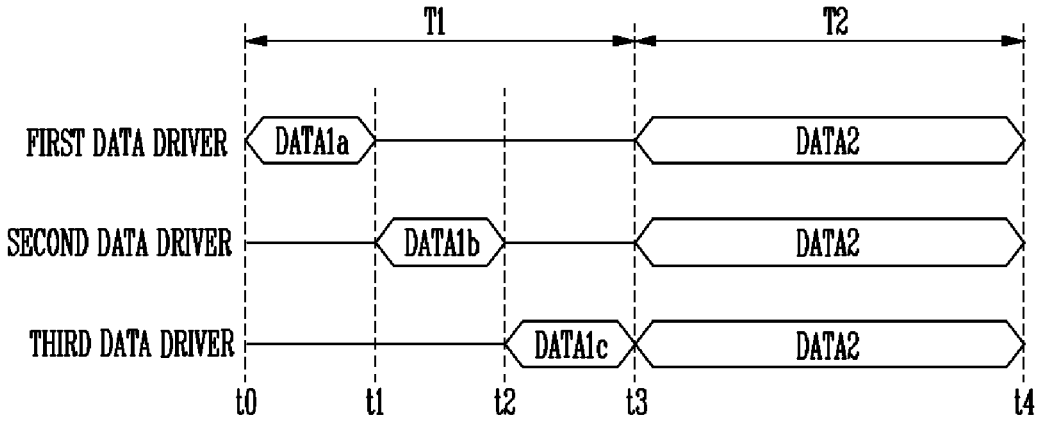
FIG. 4A is a timing diagram illustrating first and second image data that the data drivers receive from the timing controller according to an embodiment of the disclosure.
Figure 4B:
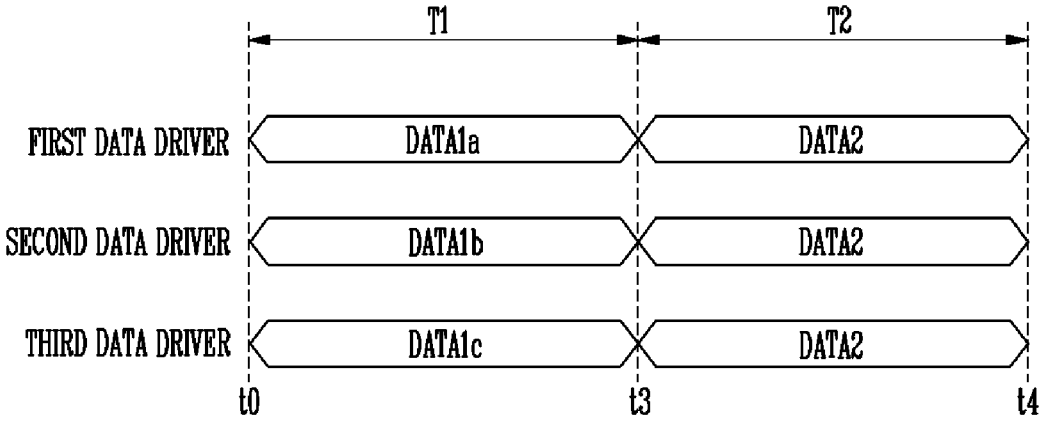
FIG. 4B is a timing diagram illustrating first and second image data that the data drivers receive from the timing controller according to another embodiment of the disclosure.

FIG. 3 is a schematic block diagram of a timing controller and data drivers according to an embodiment of the disclosure. FIG. 4A is a timing diagram illustrating first and second image data that the data drivers receive from the timing controller according to an embodiment of the disclosure. FIG. 4B is a timing diagram illustrating first and second image data that the data drivers receive from the timing controller according to another embodiment of the disclosure.

For convenience of illustration and description, only first to third data drivers 110*a* to 110*c* coupled to the timing controller 100 are illustrated in FIGS. 3, 4A and 4B, but not being limited thereto. In such an embodiment, the number of drivers coupled to the timing controller 100 may be variously changed.

Referring to FIG. 3, in an embodiment, the timing controller 100 may be coupled to the first to third data drivers 110*a* to 110*c*.

The timing controller 100 may supply first image data DATA1*a* to DATA1*c* to the first to third data drivers 110*a* to 110*c*, respectively, during a first period.

In an embodiment, the timing controller 100 may supply the first image data DATA1*a* to DATA1*c* having a same level and a same slew rate to the first to third data drivers 110*a* to 110*c*, respectively, but not being limited thereto. In such an embodiment, numbers of high logics or low logics of the first image data DATA1*a* to DATA1*c*, which are counted by the respective first to third data drivers 110*a* to 110*c*, may be different from one another.

In an embodiment, where the first to third data drivers 110*a* to 110*c* are coupled to the timing controller 100 through different lines as shown in FIG. 1, resistive elements caused by the lines, etc. may be different from one another, and errors generated by the resistive elements may also be different from one another.

In such an embodiment, a first counting result obtained as the first data driver 110*a* counts a number of high logics or low logics of the first image data DATA1*a*, and a second counting result obtained as the second data driver 110*b* counts a number of high logics or low logics of the first image data DATA1*b*, and a third counting result obtained as the third data driver 110*c* counts a number of high logics or low logics of the first image data DATA1*c* may be different from one another.

In an embodiment, the timing controller 100 may individually change levels and slew rates of the first data DATA1*a* to DATA1*c* supplied to the first to third data drivers 110*a* to 110*c*, based on first to third feedback information FDa to FDc received from the respective first to third data drivers 110*a* to 110*c*. In such an embodiment, resistive elements between the first to third data drivers 110*a* to 110*c* and the timing controller 100 may be different from one another, and hence the first to third feedback information FDa to FDc may be different from one another.

In one embodiment, for example, the timing controller 100 may supply the first image data DATA1*a* to the first data driver 110*a* and then receive the first feedback information FDa on the first image data DATA1*a* from the first data driver 110*a*. In such an embodiment, the timing controller 100 may change at least one of the level and the slew rate of the first image data DATA1*a*, based on the first feedback information FDa. The timing controller 100 may provide, to the first data driver 110*a*, first image data, at least one of the level and the slew rate of which is changed (hereinafter, referred to as first change data). As described above with reference to FIG. 2, the timing controller 100 may change at least one of the level and the slew rate of the first change data until the first counting result corresponds to the checksum.

In an embodiment, the timing controller 100 may supply the first image data DATA1*b* to the second data driver 110*b* and then receive the second feedback information FDb on the first image data DATA1*b* from the second data driver 110*b*. In such an embodiment, the timing controller 100 may change at least one of the level and the slew rate of the first image data DATA1*b*, based on the second feedback information FDb. The timing controller 100 may provide, to the second data driver 110*b*, first image data, at least one of the level and the slew rate of which is changed (hereinafter, referred to as second change data). The timing controller 100 may change at least one of the level and the slew rate of the second change data until the second counting result corresponds to the checksum.

In the same manner, the timing controller 100 may supply the first image data DATA1*c* to the third data driver 110*c* and then receive the third feedback information FDc on the first image data DATA1*c* from the third data driver 110*c*. The timing controller 100 may generate first image data, at least one of the level and the slew rate of which is changed (hereinafter, referred to as third change data), based on the third feedback information FDc, and provide the third change data to the third data driver 110*c*. The timing controller 100 may change at least one of the level and the slew rate of the third change data until the third counting result corresponds to the checksum.

When the first to third counting results correspond to the checksums, the timing controller 100 may not change the levels and slew rates of the first to third change data. In such an embodiment, the levels and slew rates of the first to third change data generated based on the first to third feedback information FDa to FDc may be different from one another.

The timing controller 100 change the level and the slew rate of the second image data DATA2 to correspond to the level and the slew rate of each of the first to third change data.

In one embodiment, for example, the timing controller 100 may provide the second image data DATA2 to the first data driver 110*a* by changing the level and the slew rate of the second image data DATA2 to correspond to the level and the slew rate of the first change data. The timing controller 100 may provide the second image data DATA2 to the second data driver 110*b* by changing the level and the slew rate of the second image data DATA2 to correspond to the level and the slew rate of the second change data. The timing controller 100 may provide the second image data DATA2 to the third data driver 110*c* by changing the level and the slew rate of the second image data DATA2 to correspond to the level and the slew rate of the third change data.

In an embodiment, as described above, the timing controller 100 may individually compensate for errors of the first and second image data DATA1 and DATA2 provided to a plurality of data drivers, respectively, based on feedback information respectively provided from the plurality of data drivers. In such an embodiment, as the error of the second image data is compensated, the image quality of the display device may be improved.

Referring to FIG. 4A, the timing controller 100 may supply the first image data DATA1*a* to DATA1*c* to the first to third data drivers 110*a* to 110*c* during different periods in a first period T1 in a frame period.

In an embodiment, the timing controller 100 may sequentially compensate for errors of the first image data DATA1*a* to DATA1*c* respectively provided to the first to third data drivers 110*a* to 110*c* during different periods.

In one embodiment, for example, the timing controller 100 may compensate for an error of the first image data DATA1*a* provided to the first data driver 110*a* in a period from a first time t0 to a second time t1 during the first period T1, compensate for an error of the first image data DATA1*b* provided to the second data driver 110*b* in a period from the second time t1 to a third time t2 during the first period T1, and compensate for an error of the first image data DATA1*c* provided to the third data driver 110*c* in a period from the third time t2 to a fourth time t3 during the first period T1.

In such an embodiment, the timing controller 100 may provide the first image data DATA1*a* to the first data driver 110*a* in the period from the first time t0 to the second time t1, and the first data driver 110*a* may provide the first feedback information FDa to the timing controller 100 by comparing the first counting result of the first image data DATA1*a* with the checksum. In such an embodiment, the first data driver 110*a* may repeat the above-described process until the first counting result corresponds to the checksum during the period from the first time t0 to the second time t1.

When the first counting result of the first image data DATA1*a* corresponds to the checksum, the timing controller 100 may provide the first image data DATA1*b* to the second data driver 110*b* in a period from the second time t1 to the third time t2, and the second data driver 110*b* may provide the second feedback information FDb to the timing controller 100 by comparing the second counting result of the first image data DATA1*b* with the checksum. In such an embodiment, the second data driver 110*b* may repeat the above-described process until the second counting result corresponds to the checksum during a period from the second time t1 to the third time t1.

In such an embodiment, when the second counting result of the first image data DATA1*b* corresponds to the checksum, the timing controller 100 may provide the first image data DATA1*c* to the third data driver 110*c* in the period from the third time t2 to the fourth time t3, and the third data driver 110*c* may provide the third feedback information FDc to the timing controller 100 by comparing the third counting result of the first image data DATA1*c* with the checksum. In such an embodiment, the third data driver 110*c* may repeat the above-described process until the third counting result correspond to the checksum during the period from the third time t2 to the fourth time t3.

In an embodiment, as described above, the timing controller 100 may sequentially compensate for the errors of the first image data DATA1*a* to DATA1*c* respectively provided to the first to third data drivers 110*a* to 110*c*.

In such an embodiment, periods in which the timing controller 100 compensate for the errors of the first image data DATA1*a* to DATA1*c* respectively provided to the first to third data drivers 110*a* to 110*c* may be different from one another, and the timing controller 100 may compensate for the second image data DATA2 during the first period T1 or a second period T2 in a frame period.

In an embodiment, as shown in FIG. 4A, the timing controller 100 supplies the second image data DATA2 to the first to third data drivers 110*a* to 110*c* immediately after the fourth time t3, but the disclosure is not limited thereto. In one alternative embodiment, for example, after a predetermined time elapses from the fourth time t3, the timing controller 100 may supply the second image data DATA2 to the first to third data drivers 110*a* to 110*c*.

Referring to FIG. 4B, in an embodiment, the timing controller 100 may supply the first image data DATA1*a* to DATA1*c* to the first to third data drivers 110*a* to 110*c* during periods, at least some of which are identical to one another in the first period T1.

In such an embodiment, the timing controller 100 may simultaneously compensate for errors of the first image data DATA1*a* to DATA1*c* respectively provided to the first to third data drivers 110*a* to 110*c* during the periods of which at least some are identical to one another.

In one embodiment, for example, in the period from the first time t0 to the fourth time t3, the timing controller 100 may simultaneously compensate for an error of the first image data DATA1*a* provided to the first data driver 110*a*, an error of the first image data DATA1*b* provided to the second data driver 110*b*, and an error of the first image data DATA1*c* provided to the third data driver 110*c*.

In such an embodiment, in the period from the first time t0 to the fifth time t4, the timing controller 100 may provide the first image data DATA1*a* to the first data driver 110*a*, provide the first image data DATA1*b* to the second data driver 110*b*, and provide the first image data DATA1*c* to the third data driver 110*c*.

In such an embodiment, in the period from the first time t0 to the fourth time t3, the first data driver 110*a* may provide the first feedback information FDa to the timing controller 100 by comparing the first counting result of the first image data DATA1*a* with the checksum, and the second data driver 110*b* may provide the second feedback information FDb to the timing controller 100 by comparing the second counting result of the first image data DATA1*b* with the checksum, and the third driver 110*c* may provide the third feedback information FDc to the timing controller 100 by comparing the third counting result of the first image data DATA1*c* with the checksum.

The timing controller 100 may change at least one of the levels and the slew rates of the first image data DATA1*a* to DATA1*c* until the first to third counting results correspond to the checksums, respectively.

In an embodiment, as described above, the timing controller 100 may simultaneously compensate for the errors of the first image data DATA1*a* to DATA1*c* respectively provided to the first to third data drivers 110*a* to 110*c*. However, in such an embodiment, the periods used to compensate for the errors of the first image data DATA1*a* to DATA1*c* respectively provided to the first to third data drivers 110*a* to 110*c* may be different from one another.

In an embodiment, as shown in FIG. 4B, the timing controller 100 provides the second image data DATA2 to the first to third data drivers 110*a* to 110*c* immediately after the fourth time t3, but the disclosure is not limited thereto. In one embodiment, for example, the timing controller 100 may provide the second image data DATA2 to the first to third data drivers 110*a* to 110*c* after a predetermined time elapses from the fourth time t3.

Figure 5A:
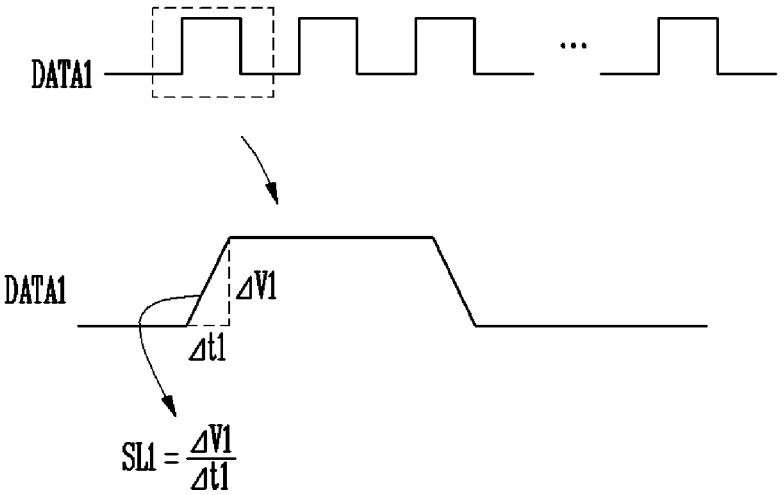
FIG. 5A is a view illustrating first image data according to an embodiment of the disclosure.
Figure 5B:
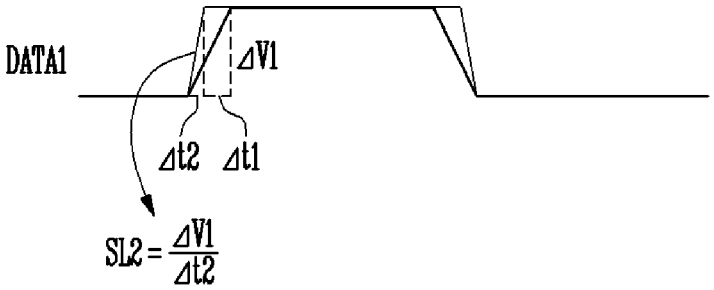
FIG. 5B is a view illustrating a method in which the data driver changes a slew rate of the first image data according to an embodiment of the disclosure.
Figure 5C:
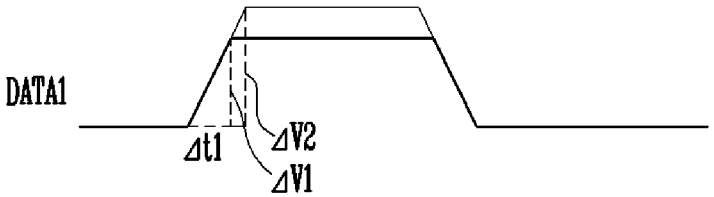
FIG. 5C is a view illustrating a method in which the data driver changes a level of the first image data according to an embodiment of the disclosure.
Figure 5D:
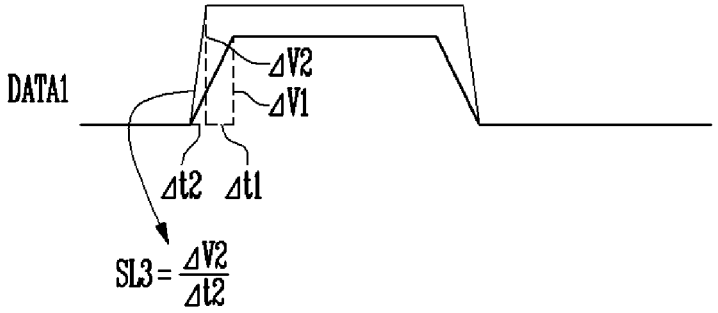
FIG. 5D is a view illustrating a method in which the data driver simultaneously changes the level and slew rate of the first image data according to an embodiment of the disclosure.

FIG. 5A is a view illustrating first image data according to an embodiment of the disclosure. FIG. 5B is a view illustrating a method in which the data driver changes a slew rate of the first image data according to an embodiment of the disclosure. FIG. 5C is a view illustrating a method in which the data driver changes a level of the first image data according to an embodiment of the disclosure. FIG. 5D is a view illustrating a method in which the data driver simultaneously changes the level and the slew rate of the first image data according to an embodiment of the disclosure.

Referring to FIG. 5A, the first image data DATA1 is a digital signal in which high logics and low logics are repeated. The slew rate of the first image data DATA1 ideally has an infinite value, but the first image data DATA1 substantially has a first slew rate SL1 defined by a first time width Δt1 and a first voltage level ΔV1.

Referring to 5B, the timing controller 100 may change the slew rate of the first image data DATA1, based on the feedback information FD provided from the data driver 110.

In one embodiment, for example, when a counting result of high logics is smaller than a checksum (a number of high logics substantially included in the first image data DATA1) or when a counting result of low logics is larger than a checksum (a number of low logics substantially included in the first image data DATA1), the timing controller 100 may increase the slew rate of the first image data DATA1 by a predetermined amount. In such an embodiment, the timing controller 100 may change the first slew rate SL1 of the first image data DATA1 to a second slew rate SL2 defined by a second time width Δt2 and a second voltage level ΔV2.

Although not shown in FIG. 5B, when the counting result of the first image data DATA1 corresponds to the checksum, the timing controller 100 may change the slew rate of the second image data DATA2 to the second slew rate SL2.

In such an embodiment, when the counting result of high logics is larger than the checksum (the number of high logics substantially included in the first image data DATA1) or when the counting result of low logics is smaller than the checksum (the number of low logics substantially included in the first image data DATA1), the timing controller 100 may change the first slew rate SL1 of the first image data DATA1 to a slew rate having a value smaller than that of the first slew rate SL1.

Referring to FIG. 5C, the timing controller 100 may change the level of the first image data DATA1, based on the feedback information FD provided from the data driver 110.

In one embodiment, for example, when the counting result of high logics is smaller than the checksum (the number of high logics substantially included in the first image data DATA1) or when the counting result of low logics is larger than the checksum (the number of low logics substantially included in the first image data DATA1), the timing controller 100 may increase the level of the first image data DATA1 by a predetermined amount such that a level difference between low and high logics becomes the second voltage level ΔV2.

Although not shown in FIG. 5C, when the counting result of the first image data DATA1 corresponds to the checksum, the timing controller 100 may increase the level of the second image data DATA2 by a predetermined amount such that the level difference between low and high logics becomes the second voltage level ΔV2.

In such an embodiment, when the counting result of high logics is larger than the checksum (the number of high logics substantially included in the first image data DATA1) or when the counting result of low logics is smaller than the checksum (the number of low logics substantially included in the first image data DATA1), the timing controller 100 may decrease the level of the first image data DATA1 by a predetermined amount such that the level difference between low and high logics is smaller than the second voltage level ΔV1.

Referring to FIG. 5D, the timing controller 100 may simultaneously change the level and the slew rate of the first image data DATA1, based on the feedback information FD provided from the data driver 110.

In one embodiment, for example, when the counting result of high logics is smaller than the checksum (the number of high logics substantially included in the first image data DATA1) or when the counting result of low logics is larger than the checksum (the number of low logics substantially included in the first image data DATA1), the timing controller 100 may increase the level of the first image data DATA1 by a predetermined amount such that the level difference between low and high logics becomes the second voltage level ΔV2, and change the slew rate of the second image data DATA2 to a third slew rate SL3.

In such an embodiment, when the counting result of high logics is larger than the checksum (the number of high logics substantially included in the first image data DATA1) or when the counting result of low logics is smaller than the checksum (the number of low logics substantially included in the first image data DATA1), the timing controller 100 may decrease the level of the first image data DATA1 by a predetermined amount such that the level difference between low and high logics is smaller than the first voltage level ΔV1, and change the first slew rate SL1 of the first image data DATA1 to a slew rate having a value smaller than that of the first slew rate SL1.

Figure 6:
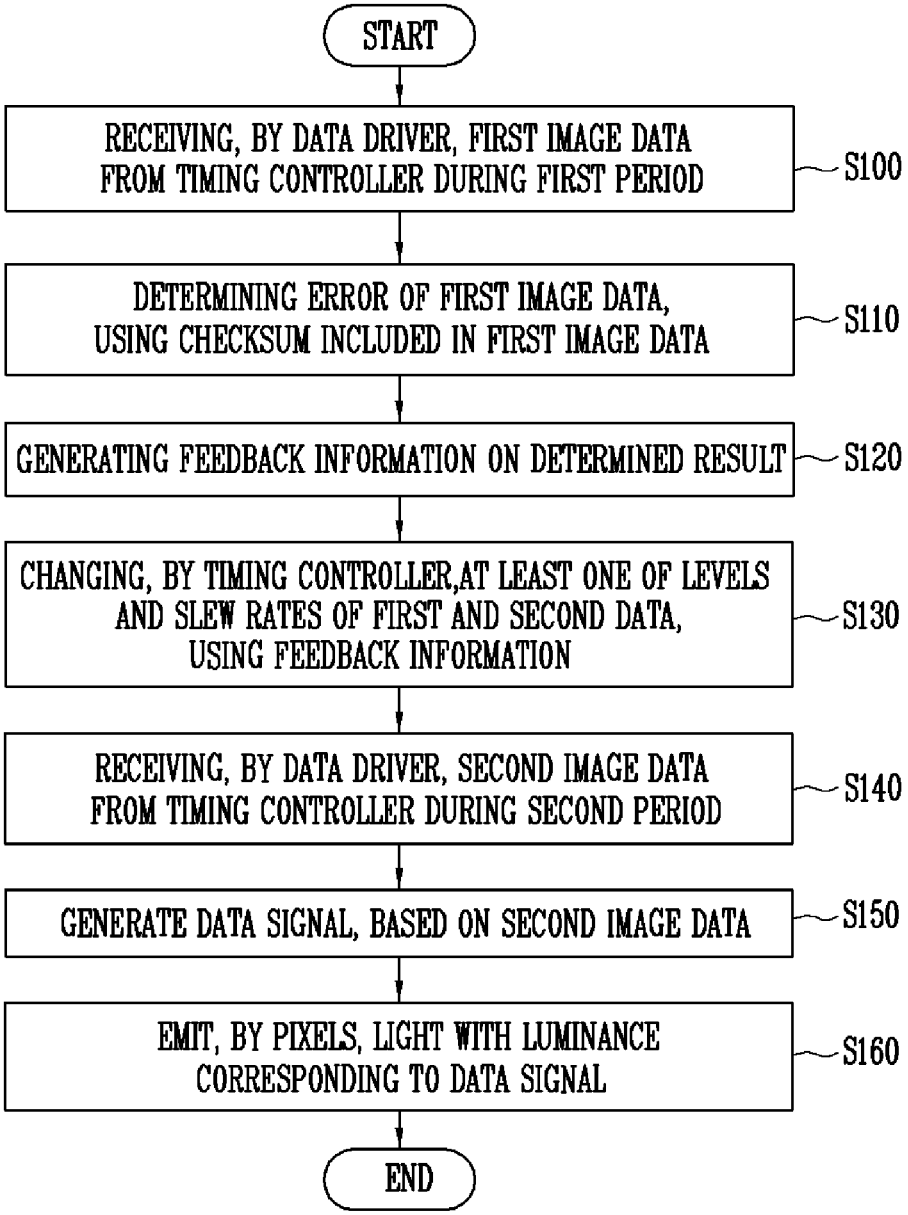
FIG. 6 is a flowchart illustrating an operating method of the display device according to an embodiment of the disclosure.

FIG. 6 is a flowchart illustrating an operating method of the display device according to an embodiment of the disclosure.

Referring to FIG. 6, the data driver 110 may receive first image data DATA1 from the timing controller 100 during a first period T1 in a frame period (S100).

The data driver 110 may determine an error of the first image data DATA1, based on a checksum included in the first image data DATA1 (S110). The data driver 110 may generate feedback information FD on the determined result, and provide the generated feedback information FD to the timing controller 100 (S120).

The timing controller 100 may change a level of the first image data DATA1 and a slew rate of the first image data DATA1, based on the feedback information FD. In such an embodiment, the timing controller 100 may change a level of second image data DATA2 and a slew rate of the second image data DATA2 to correspond to the level and the slew rate of the first image data DATA1 (S130).

The data driver 110 may receive the second image data DATA2 from the timing controller 100 during a second period T2 (S140) in the frame period, and generate a data signal, based on the second image data DATA2 (S150).

The pixels PXL may emit light with a luminance corresponding to the data signal (S160).

In embodiments of the display device and the operating method thereof according to the disclosure, an error of image data transmitted from the timing controller to the data driver may be determined before an image is displayed. In such embodiments, the error of the image data may be effectively prevented by compensating for at least one of the level and the slew rate of the image data.

In such embodiments of the display device and the operating method thereof according to the disclosure, errors of image data respectively provided to a plurality of data drivers may be individually compensated or compensated independently of each other. In such embodiments, as the errors of the image data are compensated, the image quality of the display device may be improved.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the disclosure as set forth in the following claims.

What is claimed is:

1. A display device comprising:

a timing controller which receives image data including high logics and low logics from an outside;

a data driver which generates a data signal, based on the image data; and pixels which emit light with a luminance corresponding to the data signal, wherein the data driver determines an error of the image data, based on a checksum included in the image data, the data driver counts a number of high logics or low logics of the image data, and the data driver generates feedback information on the error by comparing a counted number of the high logics or the low logics of the image data with the checksum included in the image data.

2. The display device of claim 1, wherein the data driver receives first image data from the timing controller during a first period of a frame period, and the data driver determines an error of the first image data, based on a checksum included in the first image data.

3. The display device of claim 2, wherein the checksum included in the first image data is the number of the high logics or the low logics existing in the first image data.

4. The display device of claim 2, wherein the timing controller changes at least one of a level of the first image data and a slew rate of the first image data, based on the feedback information.

5. The display device of claim 4, wherein when the counted number of the high logics of the first image data is smaller than the checksum, the timing controller increases the level of the first image data by a predetermined amount.

6. The display device of claim 4, wherein when the counted number of the high logics of the first image data is larger than the checksum included in the first image data, the timing controller decreases the level of the first image data by a predetermined amount.

7. The display device of claim 4, wherein when the counted number of the high logics of the first image data is smaller than the checksum included in the first image data, the timing controller increases the slew rate of the first image data by a predetermined amount.

8. The display device of claim 4, wherein when the counted number of the high logics of the first image data is larger than the checksum included in the first image data, the timing controller decreases the slew rate of the first image data by a predetermined amount.

9. The display device of claim 4, wherein the timing controller receives second image data during a second period of the frame period, which is subsequent to the first period in the frame period, and the timing controller changes at least one of a level of the second image data and a slew rate of the second image, based on the feedback information.

10. The display device of claim 9, wherein the data driver generates the data signal, based on the second image data.

11. The display device of claim 1, wherein the data driver comprises a first data driver and a second data driver, which supply the data signal to different pixels among the pixels.

12. The display device of claim 11, wherein the first and second data drivers receive the image data during different periods from each other, and each of the first and second data drivers determines the error of the image data, based on the checksum included in the image data.

13. The display device of claim 11, wherein the first and second data drivers receive the image data during periods, at least some of which overlap with each other, and each of the first and second data drivers determines the error of the image data, based on the checksum included in the image data.

14. A method for operating a display device, the method comprising:

receiving, by a data driver of the display device, first image data including high logics and low logics from a timing controller of the display device during a first period of a frame period;

determining, by the data driver, an error of the first image data, based on a checksum included in the first image data;

generating, by the data driver, feedback information on the determined error and transmitting the generated feedback information to the timing controller; and changing, by the timing controller, at least one of a level of the first image data and a slew rate of the first image data, based on the feedback information, wherein the determining, by the data driver, the error of the first image data, based on the checksum included in the first image data comprises:

counting a number of high logics or low logics of the first image data; and determining the error by comparing the counted number of the high logics or the low logics of the first image data with the checksum included in the first image data.

15. The method of claim 14, further comprising:

receiving, by the data driver, second image data from the timing controller during a second period of the frame period, which is subsequent to the first period;

changing, by the data driver, at least one of a level of the second image data and a slew rated of the second image, based on the feedback information;

generating, by the data driver, a data signal, based on the second image data; and emitting, by pixels, light with a luminance corresponding to the data signal.

16. The method of claim 14, wherein the changing, by the timing controller, the at least one of the level of the first image data and the slew rate of the first image, based on the feedback information comprises:

increasing the level of the first image data by a predetermined amount when the counted number of the low logics of the first image data is larger than the checksum included in the first image data; and decreasing the level of the first image data by a predetermined amount when the counted number of the low logics is smaller than the checksum included in the first image data.

17. The method of claim 14, wherein the changing, by the timing controller, the at least one of the level of the first image data and the slew rate of the first image data, based on the feedback information comprises: increasing the slew rate of the first image data by a predetermined amount when the counted number of the low logics of the first image data is larger than the checksum included in the first image data.

18. The method of claim 14, wherein the changing, by the timing controller, the at least one of the level of the first image data and the slew rate of the first image data, based on the feedback information comprises: decreasing the slew rate of the first image data by a predetermined amount when the counted number of the low logics of the first image data is smaller than the checksum included in the first image data.

* * * * *